US010149033B2

(12) United States Patent
Karacal

(10) Patent No.: US 10,149,033 B2
(45) Date of Patent: Dec. 4, 2018

(54) EAR CUP VENTING MECHANISM FOR GAMING HEADSET

(71) Applicant: Performance Designed Products LLC, Burbank, CA (US)

(72) Inventor: Ozhan Karacal, San Diego, CA (US)

(73) Assignee: Performance Designed Products LLC, Burbank, CA (US)

( * ) Notice: Subject to any disclaimer, the term of this patent is extended or adjusted under 35 U.S.C. 154(b) by 0 days.

(21) Appl. No.: 15/645,477

(22) Filed: Jul. 10, 2017

(65) Prior Publication Data

US 2018/0220219 A1 Aug. 2, 2018

Related U.S. Application Data

(60) Provisional application No. 62/452,646, filed on Jan. 31, 2017.

(51) Int. Cl.
*H04R 1/10* (2006.01)

(52) U.S. Cl.
CPC ..... *H04R 1/1008* (2013.01); *H04R 1/105* (2013.01); *H04R 1/1041* (2013.01); *H04R 1/1066* (2013.01); *H04R 1/1075* (2013.01); *H04R 1/1091* (2013.01); *H04R 2460/11* (2013.01)

(58) Field of Classification Search
CPC combination set(s) only.
See application file for complete search history.

(56) References Cited

U.S. PATENT DOCUMENTS 4,620,068 A 10/1986 Wieder
9,332,337 B2 * 5/2016 Ridler ..... H04R 1/1058
2006/0015989 A1 1/2006 Faussett et al.
2011/0002478 A1 1/2011 Pollard et al.
2012/0063619 A1 3/2012 Hildebrandt et al.
2012/0140961 A1 6/2012 Reiss et al.
2012/0207320 A1 * 8/2012 Avital ..... H04R 1/1041 381/74

(Continued)

FOREIGN PATENT DOCUMENTS

GB 1 297 753 11/1972
GB 1 376 455 A 12/1974

OTHER PUBLICATIONS

International Search Report and Written Opinion dated Mar. 8, 2018 received in International Application No. PCT/US2017/066628, 18 pages.

(Continued)

*Primary Examiner* — Amir Etesam

(74) *Attorney, Agent, or Firm* — Knobbe, Martens, Olson & Bear LLP

(57) ABSTRACT

A gaming headset can be provided that includes a headband that fits over a user's head and a pair of ear cup assemblies coupled to the headband. Each of the ear cup assemblies can include an ear pad and a housing. A hinge assembly on a front side of the ear cup assembly can movably couple the housing and the ear pad and can be defined by a hook of the ear pad that couples to a slot in the housing. An actuator on a rear side of the ear cup assembly can be actuated to move the ear pad between a first position in contact with the housing and a second position tilted relative to the housing to define a rearward facing gap therebetween that vents an in-ear space between the ear pad and the housing.

20 Claims, 15 Drawing Sheets

(56) References Cited

U.S. PATENT DOCUMENTS

| | | | |
|---|---|---|---|
| 2015/0036834 | A1 | 2/2015 | Bauman et al. |
| 2015/0222980 | A1 | 8/2015 | Pizzaro et al. |

OTHER PUBLICATIONS

The Tech Report, "A Quick Look at Psyko's 5.1 PC Gaming Headset Surround-Sound Headphones Perfected?", Apr. 22, 2010, http://techreport.com/review/18794/a-quick-look-at-psyko-5-1-pc-gaming-headset.

* cited by examiner

EAR CUP VENTING MECHANISM FOR GAMING HEADSET

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

The present invention is directed to a headset, and more particularly to a gaming headset with a venting mechanism to improve cooling performance of the headset.

Description of the Related Art

Gaming is a popular hobby in many countries around the world. Video games have become increasingly complex and allow gamers to play against individuals in the same location (e.g., same room, tournaments) or in remote locations (e.g., different cities or countries) via the internet. In addition to the visual aspects of the video games, sound also plays an important part in providing the gaming experience. Usually, a gamer will wear a headset that provides direct sound to the user's ears, as well as includes a microphone to allow the gamers to communicate with each other.

Gaming enthusiasts and professional gamers can dedicate significant periods of time to playing such interactive games. It's common that gamers can spend up to 20 hours a week (e.g., 3 hours every day) playing video games. Additionally, gamers can normally spend consecutive hours (e.g., 2 hours to 4 hours) per sitting playing a game. In some cases, professional gamers can spend hours playing in contests, which requires them to wear the gaming headset for significant periods of time.

One problem with current gaming equipment (e.g., headsets), is that gamers can suffer discomfort from wearing the headsets for prolonged or extended periods of time (e.g., 2 hours, 4 hours, 6 hours) while playing or competing. For example, prolonged wearing of the gaming headset can lead to increased perspiration (caused by humidity) and increased temperature around the user's ears (e.g., due to an increase in temperature of the ear pad or temperature of the air in the ear cup). Additionally, the headband of the headsets features a certain clamping force which helps fix the ear cups around user's ears as well as providing a passive acoustic seal that helps the user block out external noise. This pressure and seal also adds to user's perception of increased temperature and humidity levels.

SUMMARY

Accordingly, there is a need for an improved gaming headset that can be address at least some of the problems identified above.

In accordance with one aspect, a gaming headset can be provided that includes a headband that fits over a user's head and a pair of ear cup assemblies coupled to the headband. Each of the ear cup assemblies can include an ear pad and a housing. A hinge assembly on one side (optionally a front side) of the ear cup assembly can movably couple the housing and the ear pad and can be defined by a hook of the ear pad that couples to a slot in the housing. An actuator on a rear side of the ear cup assembly can be actuated to move the ear pad between a first position in contact with the housing and a second position tilted relative to the housing to define a gap (e.g., a rearwardly facing gap) on an opposite side (optionally a rear side) of the ear cup assembly that vents an in-ear space between the ear pad and the housing.

Optionally, the ear pad can be held in contact with the housing by magnets of opposing polarities embedded in the ear pad and the housing. Optionally, the housing can include an inner housing and an outer housing, the inner housing interposed between the inner housing and the ear pad. Optionally, the hinge assembly can have a hinge body made of a shape memory material configured to bias the ear pad into contact with the housing and to flex when the actuator moves the cam surface into the deployed position.

In accordance with one embodiment, an ear cup assembly for a headset is provided. The ear cup assembly comprises a housing comprising one or more magnets and an ear pad configured to extend over user's ear. The ear pad is pivotally coupled to the housing along one side of the ear cup assembly by a hinge, the ear pad comprising one or more magnets that have an opposite polarity than the one or more magnets in the housing. The ear pad is configured to pivot between a closed position and an open position relative to the housing. In the closed position the magnets in the ear pad and the housing exert an attractive force therebetween to retain the ear pad in contact with the housing about a circumference of the ear pad. In the open position the ear pad is inclined away from the housing to overcome the attractive force and define a gap on an opposite side of the ear cup assembly from the hinge to vent a space between the ear pad and the housing.

In accordance with another embodiment, an ear cup assembly for a headset is provided. The ear cup assembly comprises a housing comprising a plurality of magnets and an ear pad configured to extend over user's ear. The ear pad is pivotally coupled to the housing along one side of the ear cup assembly by a hinge, the ear pad comprising a plurality of magnets that have an opposite polarity than the one or more magnets in the housing. The ear pad is configured to pivot between a closed position and an open position relative to the housing. In the closed position the magnets in the ear pad align with the magnets in the housing and exert an attractive force therebetween to retain the ear pad in contact with the housing. In the open position the ear pad is inclined away from the housing to overcome the attractive force and define a gap on an opposite side from the hinge to vent a rear portion of the user's ear.

In accordance with another embodiment, in combination with a band of a headset a pair of ear cup assemblies is provided. Each ear cup assembly comprises an ear pad configured to extend over user's ear, the ear pad pivotally coupled to a housing along one side of the ear cup assembly by a hinge. The ear pad comprises a plurality of magnets that align with a plurality of magnets in the housing, the ear pad configured to pivot between a closed position and an open position relative to the housing. In the closed position the magnets in the ear pad and the housing exert an attractive force to bias the ear pad into contact with the housing. In the open position the ear pad is inclined away from the housing to overcome the attractive force and define a gap in the ear cup assembly configured to vent a rear of the user's ear.

In accordance with another embodiment, a gaming headset can be provided. The headset can include a headband configured to fit over a user's head and a pair of ear cup assemblies coupled to the headband via a pair of arms. Each ear cup assembly can include an ear pad, an outer housing and an inner housing interposed between the outer housing and the ear pad. A hinge assembly on a front facing side of the ear cup assembly movably couples the inner housing and the ear pad, the hinge assembly comprising a hook releasably coupled to a slot in the inner housing. An actuator is disposed on a rear facing side of the ear cup assembly from the hinge assembly. The actuator is selectively acuatable to move a cam surface between a retracted position in the inner housing and a deployed position protruding from the inner housing. In the retracted position the ear pad is in contact with the inner housing. In the deployed position the cam surface is moved into contact with a surface of the ear pad to tilt at least a portion of the ear pad relative to the inner housing to define a gap therebetween that opens toward the rear of the ear cup assembly and vents an in-ear space bounded by the ear pad and the inner housing. Optionally, one or more magnets can be disposed in the inner housing and in the ear pad with opposing polarities to apply an attraction force between the ear pad and the inner housing that biases the ear pad into contact with the inner housing.

In accordance with another aspect, a gaming headset is provided. The headset comprises a headband configured to fit over a user's head and a pair of ear cup assemblies coupled to the headband. Each ear cup assembly comprises an ear pad, an outer housing and an inner housing interposed between the outer housing and the ear pad. A hinge assembly on one side of the ear cup assembly movably couples the inner housing and the ear pad. An actuator is disposed on an opposite side of the ear cup assembly from the hinge assembly. The actuator is selectively acuatable to move a cam surface between a retracted position in the inner housing and a deployed position protruding from the inner housing. In the retracted position the ear pad is in contact with the inner housing. In the deployed position the cam surface is moved into contact with a surface of the ear pad to separate at least a portion of the ear pad from the inner housing to define a gap therebetween that vents an in-ear space in the ear cup assembly bounded by the ear pad and the inner housing. Optionally, one or more magnets can be disposed in the inner housing and in the ear pad with opposing polarities to apply an attraction force between the ear pad and the inner housing that biases the ear pad into contact with the inner housing.

DETAILED DESCRIPTION

Figure 1:
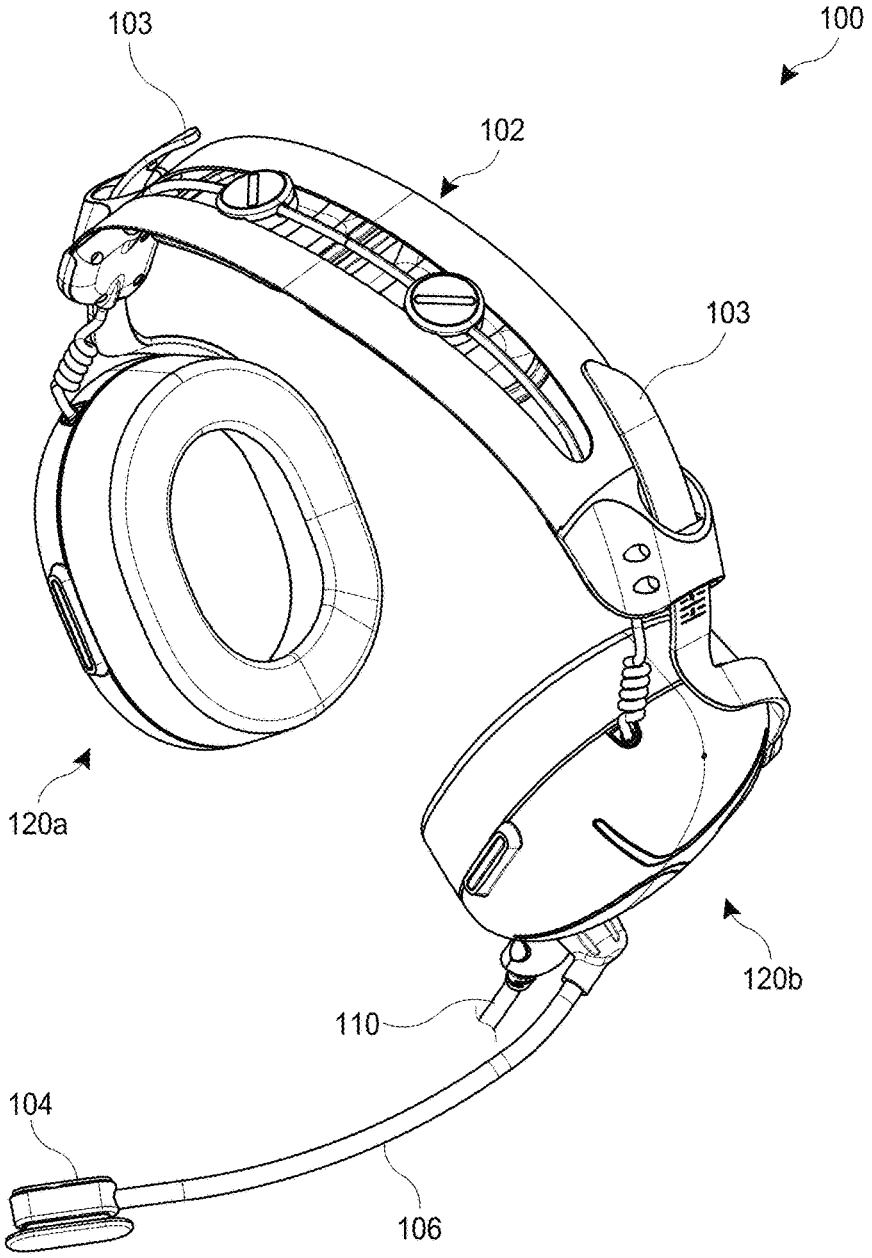
FIG. 1 is a perspective view of one embodiment of a gaming headset.
Figure 2:
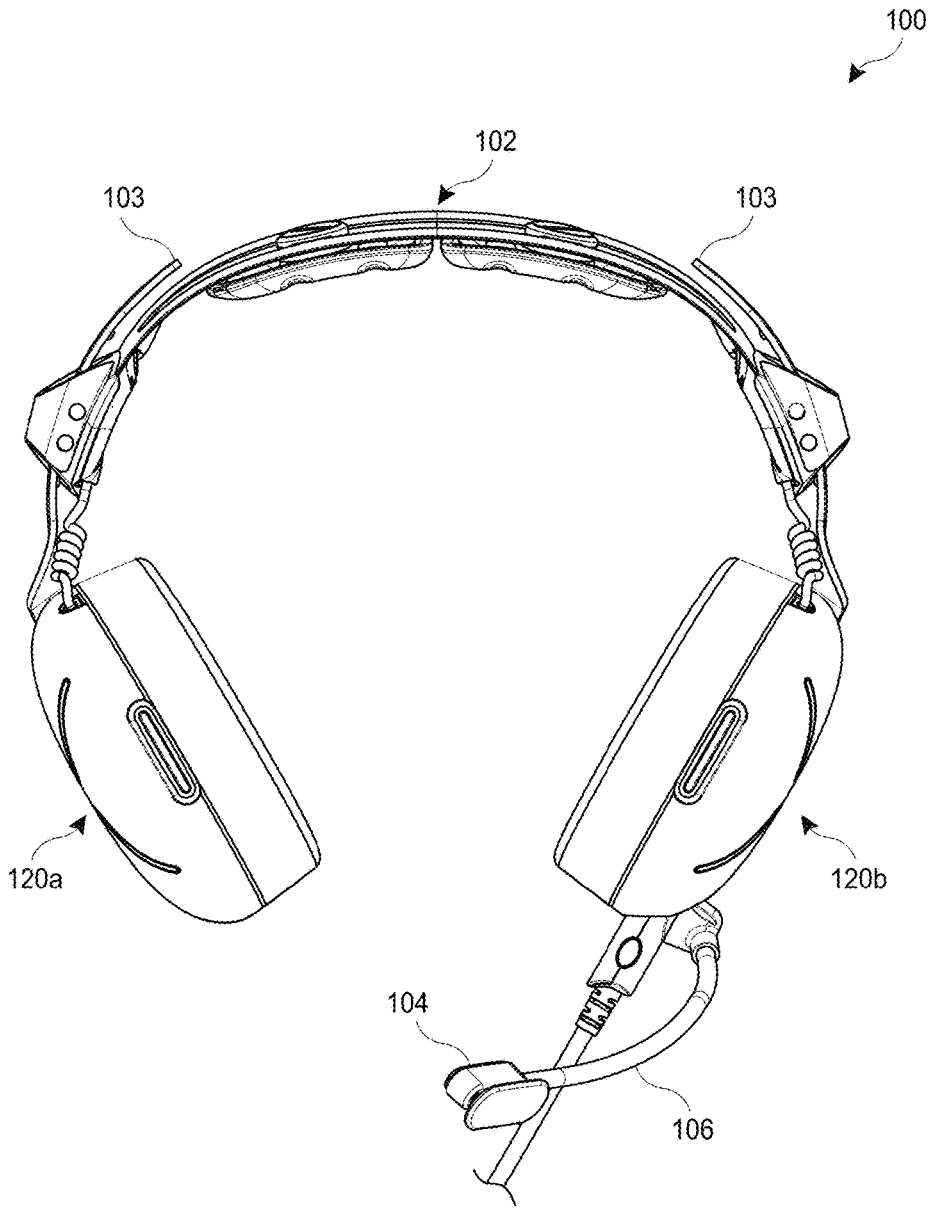
FIG. 2 is a front view of the gaming headset in FIG. 1.
Figure 3:
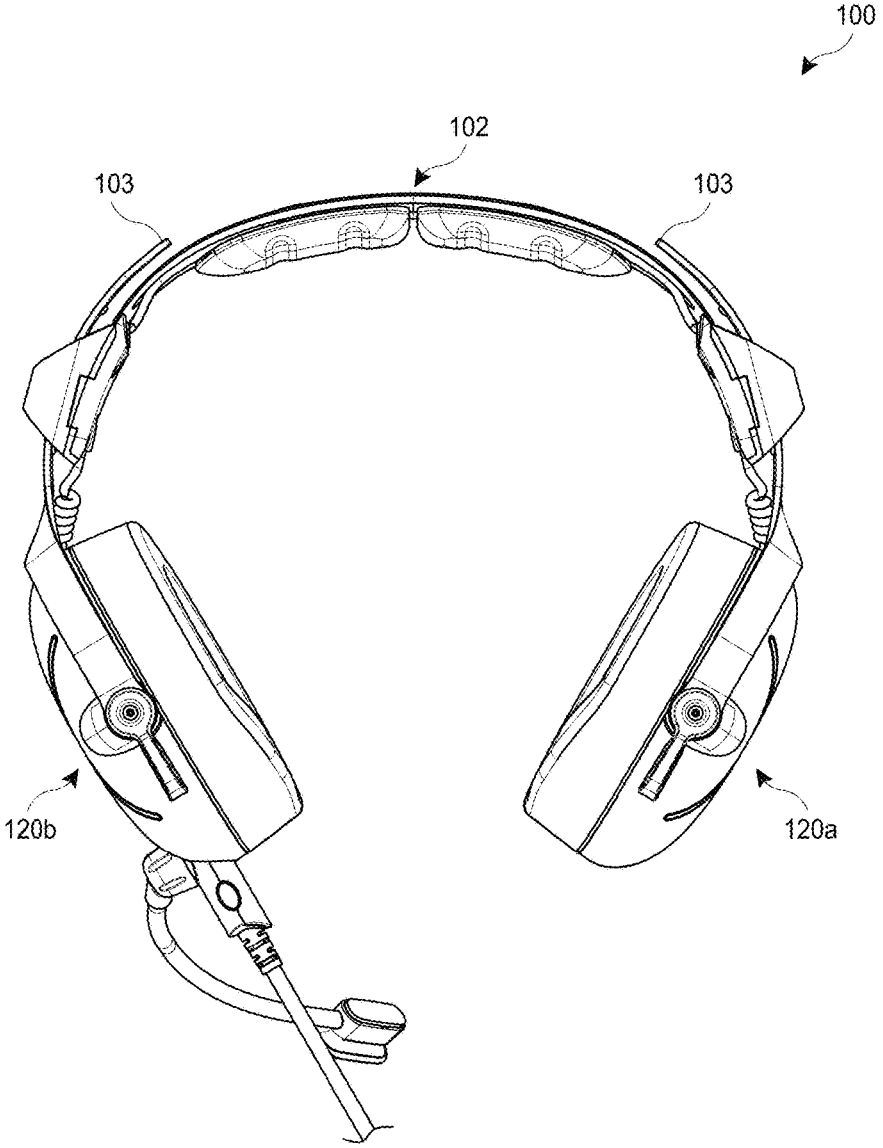
FIG. 3 is a rear view of the gaming headset in FIG. 1.

FIGS. 1-11 show an embodiment of a gaming headset 100. The gaming headset 100 can have a headband 102 coupled to a pair of ear cup assemblies 120, specifically a right ear cup assembly 120*a* and a left ear cup assembly 120*b*, via arms 103. The headband 102 can apply a compressive force on the user's head during use of the headset 100 to hold the ear cup assemblies 120 against the user's ears. The headset 100 can also include a microphone 104 attached to a microphone boom 106 that can optionally be pivotally coupled to one of the ear cup assemblies 120. The microphone 102 can convert acoustic waves (e.g., the voice of the user wearing the headset 100) to electric signals that are processed by circuitry of the headset 100.

The headset 100 can also optionally have a connector 110 on one of the ear cup assemblies 120. The connector 110 may be, for example, a headphone socket for receiving analog audio signals (e.g., receiving chat audio via an Xbox "talkback" cable), FIGS. 4-11 show partial views of one of the ear cup assemblies 120 of the headset 100. Though the description below is with respect to the left ear cup assembly 120*b*, one of skill in the art will recognize that it also applies to the right ear cup assembly 120*a*. In FIGS. 4-11, the microphone 104, boom 106 and connector 110 are excluded to facilitate illustration of internal components of the ear cup assembly 120*b*.

The ear cup assembly 120*b* includes an ear pad 130, an outer housing 140 and an inner housing 150 disposed between the outer housing 140 and the ear pad 130.

The ear pad 130 can have a distal surface 132 that contacts the user's head during use. For example, the distal surface 132 can be an annular surface that contacts the user's head about the ear, so that the ear extends into a cavity or space 134 circumscribed by the ear pad wall 136. The ear pad 130 can have a proximal surface 138 that contacts the inner housing 140 as described further below. The ear pad 130 can optionally have a protrusion, hook or tab 139 (best shown in FIG. 11) that extends proximally of the proximal surface 138 of the ear pad 130. In the illustrated embodiment, the tab 139 can generally have an L-shape.

The inner housing 150 can house electronics (not shown) associated with the ear cup assembly 120*b*, such as a speaker, circuitry, etc. The inner housing 150 can have a distal surface 152 that selectively contacts at least a portion of the proximal surface 138 of the ear pad 130, as further described below. The inner housing 150 can also have a slot or opening 154 that optionally receives therein at least a portion of the tab 139 of the ear pad 130, such that the tab 139 and slot 154 provide a hinged connection 137 between the ear pad 130 and the inner housing 150 at a front side F of the ear cup assembly 120*b*.

In one embodiment, the distal surface 152 of the inner housing 150 can removably contact the proximal surface 138 of the ear pad 130. Optionally, the inner housing 150 can have one or more magnets 156 disposed in corresponding recessed cavities 158 of the inner housing 150 that are recessed relative to the distal surface 152, and the ear pad 130 can have one or more magnets 135 disposed within the ear pad wall 136 underneath the proximal surface 138 of the ear pad 130. The magnets 156 in the inner housing 150 an the magnets 135 in the ear pad 130 can have opposite polarities so that they generate an attractive magnetic force between them, which biases the ear pad 130 into contact with the inner housing 150 and substantially retains the ear pad 130 in contact with the inner housing 150. In one embodiment, the one or more magnets 156 can be made of Neodymium. However, other suitable materials can be used. In one embodiment, the ear cup assembly 120*b* can have 8 magnets, with four distributed circumferentially in the housing 150 and four distributed circumferentially in the ear pad 130. However, in other embodiments, the ear cup assembly 120*b* can have more or fewer magnets than these.

Figure 5:
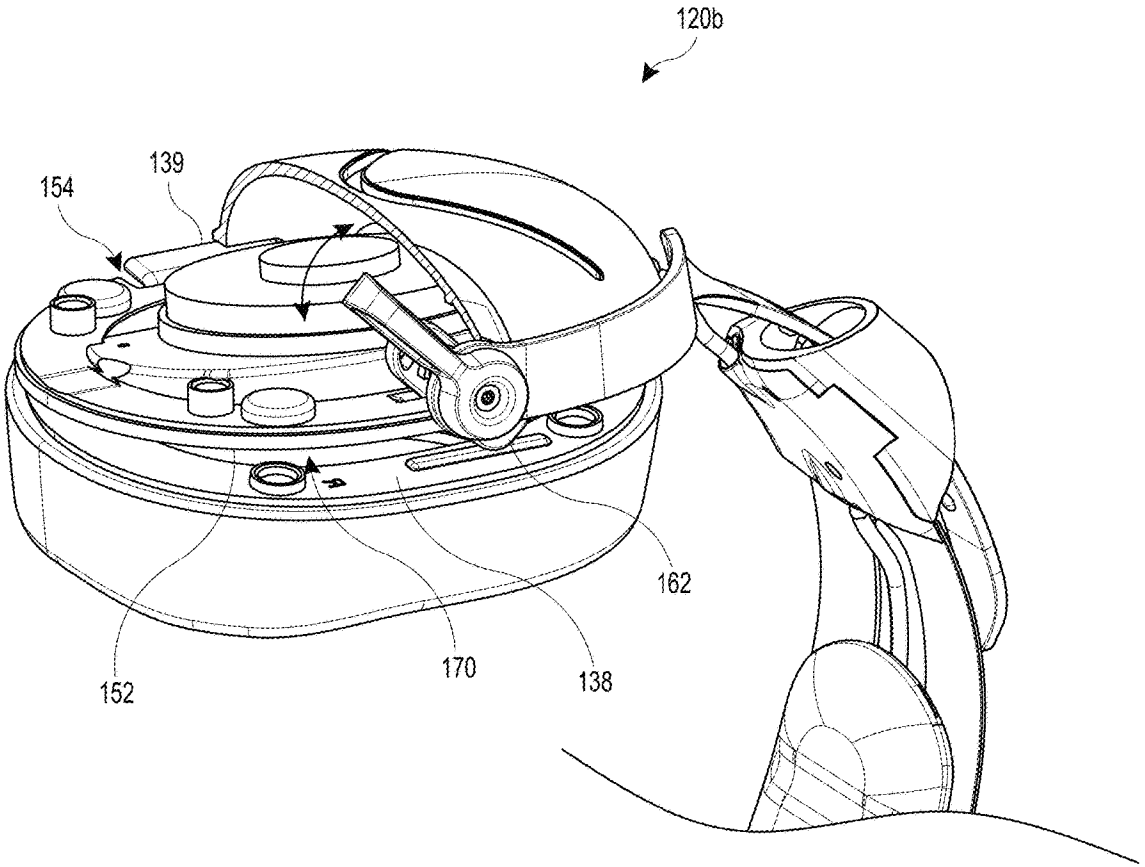
FIG. 5 is a partial perspective view of the ear cup assembly of the gaming headset of FIG. 1, with the ear pad moved to a first position spaced apart from the inner housing.

The ear cup assembly 120*b* can also include an actuator 160 that can be selectively actuated to separate at least a portion of the ear pad 130 from the inner housing 150 to define a gap 170 therebetween (see FIG. 5). In some embodiments, the actuator 160 can be a mechanical actuator. The actuator 160 can optionally be disposed on a rear side R of the ear cup assembly 120*b*, and actuation of the actuator 160 can in one embodiment separate a rear facing portion of the ear pad 130 from a rear facing portion of the inner housing 150 along at least a portion of the circumference of the ear cup assembly 120*b* such that the gap 170 is defined between the ear pad 130 and the inner housing 150 on the rear side R of the ear cup assembly 120*b* (e.g., so that the ear pad 130 is tilted relative to the inner housing 150 such that the proximal surface 138 of the ear pad 130 and the distal surface 152 of the inner housing 150 extend at an acute angle relative to each other). The gap 170 can advantageously facilitate ventilation of the user's ears. Locating the actuator 160 on the rear side R of the ear cup assembly 120*b* advantageously allows ventilation of the rear of the ear, which is the area of the ear that experiences a greater increase in humidity and temperature during use of conventional headsets. Additionally, separating the ear pad 130 from the inner housing 150 on the rear side R of the ear cup assembly 120*b*, allows the gap 170 to not be easily visible by individuals facing the user wearing the headset 100, and can allow the user to hear ambient sound (e.g., communications from others near the user).

In one embodiment, the maximum gap 170 can advantageously be about 10 mm, which the inventors have found provides an optimum amount of cooling to the in-ear space of the ear cup assembly 120*b*, does not result in a noticeable increase in discomfort to the user from an increase in a compressive force on the user's head (over and above the compressive force applied by the headband 102) due to the actuation of the actuator 160 to generate the gap 170, and does not adversely affect the acoustic performance of the headset 100. Testing conducted by applicant confirmed that a maximum gap 170 of about 10 mm resulted in an average decrease in in-ear temperature of about 3.7 degrees F., and a decrease in relative humidity of about 34%. However, in other embodiments, the actuator 160 can be actuated to provide different size openings for the gap 170. In some embodiments, the gap 170 can be about 15 mm, about 12 mm, about 5 mm, about 3 mm, or values in between these.

Figure 4:
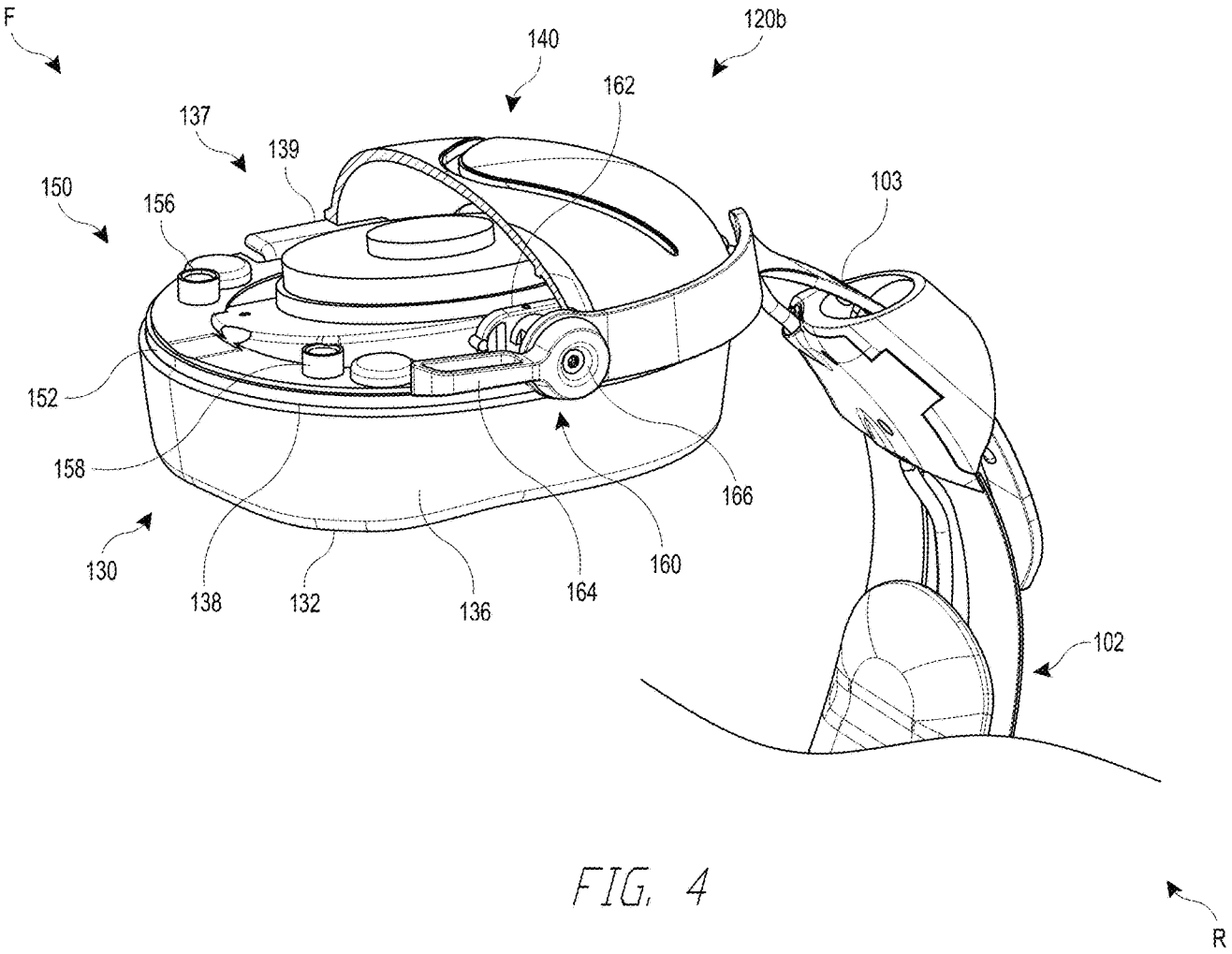
FIG. 4 is a partial view of an ear cup assembly of the gaming headset of FIG. 1, with the ear pad in a closed position against the inner housing.
Figure 6:
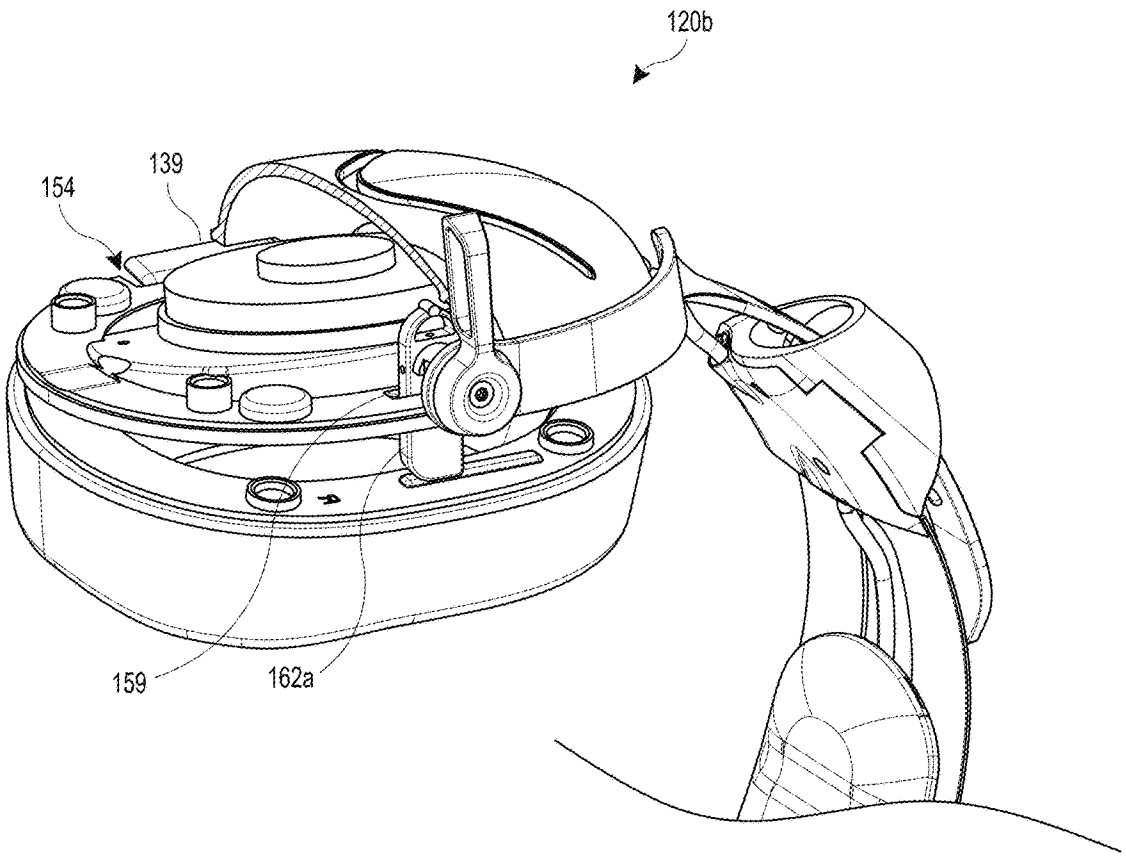
FIG. 6 is a partial perspective view of the ear cup assembly of the gaming headset of FIG. 1, with the ear pad moved to a second position spaced apart from the inner housing.

With reference to FIGS. 1-4, the actuator 160 is a mechanical actuator with a cam 162 that pivotally connected to a handle 164 and can rotate about a pivot axis 166. In the illustrated embodiment, the cam 162 and the handle 164 are generally co-planar. However, in other embodiments, the cam 162 and handle 164 can extend along separate planes. As shown in FIGS. 4-6, the cam 162 extends along an axis X1 that is offset from an axis X2 of the handle 164, so that the handle 164 is positioned outside the inner housing 150, while the cam 162 is disposed within the periphery of the inner housing 150 and between the ear pad 130 and the outer housing 140.

The cam 162 can rotate between a retracted position (see FIG. 4) and a deployed position (see FIG. 6). In the retracted position, the cam 162 does not protrude past the distal surface 152, so that the ear pad 130 is flush against the distal surface 152 of the inner housing 150. For example, in the retracted position, the cam 162 can extend within a recess or opening in the inner housing 150. In the deployed position, the cam 162 can protrude past the distal surface 152 and exert a force on the proximal surface 138 of the ear pad 130 to push the ear pad 130 away from the inner surface 152 to define the gap 170. As the cam 162 is moved from the retracted position to the deployed position, a cam surface 162*a* of the cam 162 contacts and bears against the proximal surface 138 of the ear pad 130 and separates the ear pad 130 from the inner housing 150. When in the fully deployed position, the cam optionally contacts a stop 159 in the inner housing 150 that inhibits further rotation of the cam 162. Advantageously, the cam surface 162*a* is curved so as to provide gradual and smooth opening of the gap 170 and inhibit a jerking motion or clicking noise during operation of the cam 162. In one embodiment, the cam 162 has two stable or neutral positions—the fully retracted position (see FIG. 4) and the fully deployed position (see FIG. 6) that provides the maximum gap 170, where the ear cup assembly 120*b* can remain in said positions for an indefinite period of time until the user actuates the actuator 160 to change its position. In another embodiment, the cam 162 can have a plurality of stable or neutral positions to which the cam 162 can be rotated between the fully retracted position and the fully deployed position to provide a plurality of different size gaps 170. For example, the actuator 160 an include a ratchet mechanism that allows the cam 162 to rotate to a plurality of deployed positions to define different gap sizes, and a release to allow the cam 162 to be rotated back to the retracted position.

Figure 7:
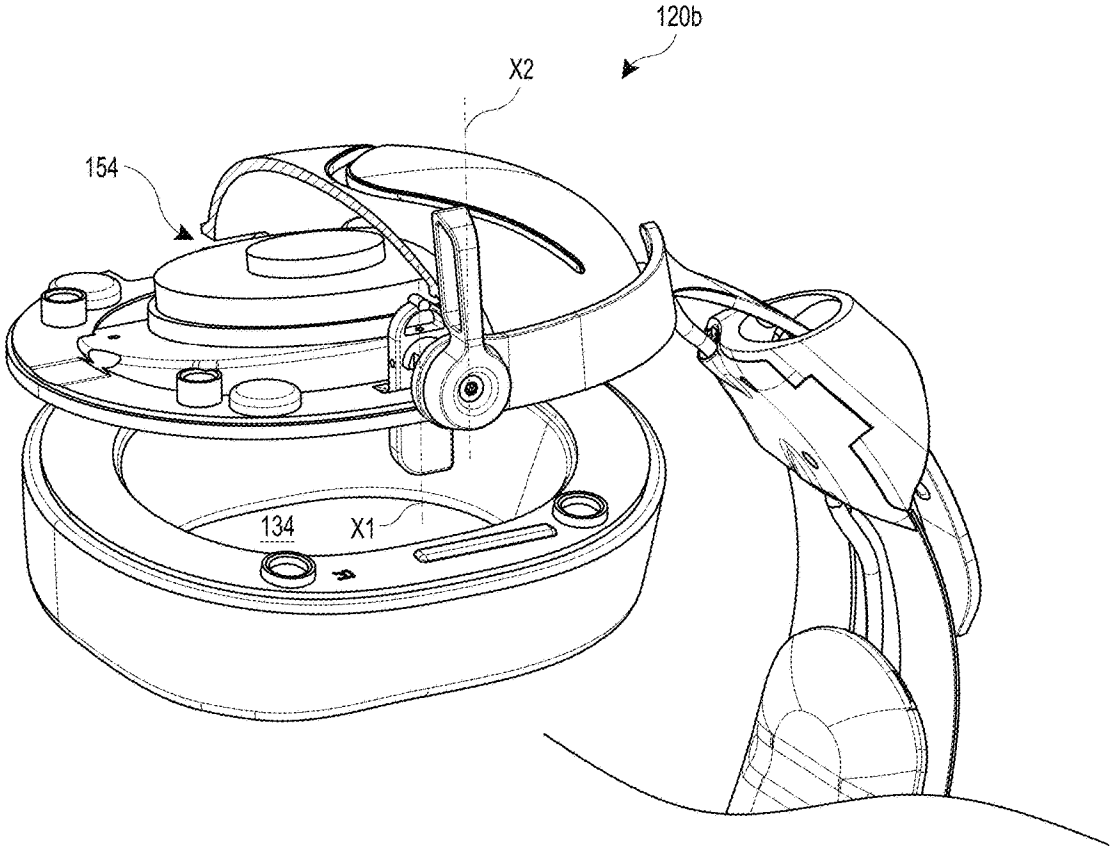
FIG. 7 is a partial perspective view of the ear cup assembly of the gaming headset of FIG. 1, with the ear pad decoupled from the inner housing.
Figure 8:
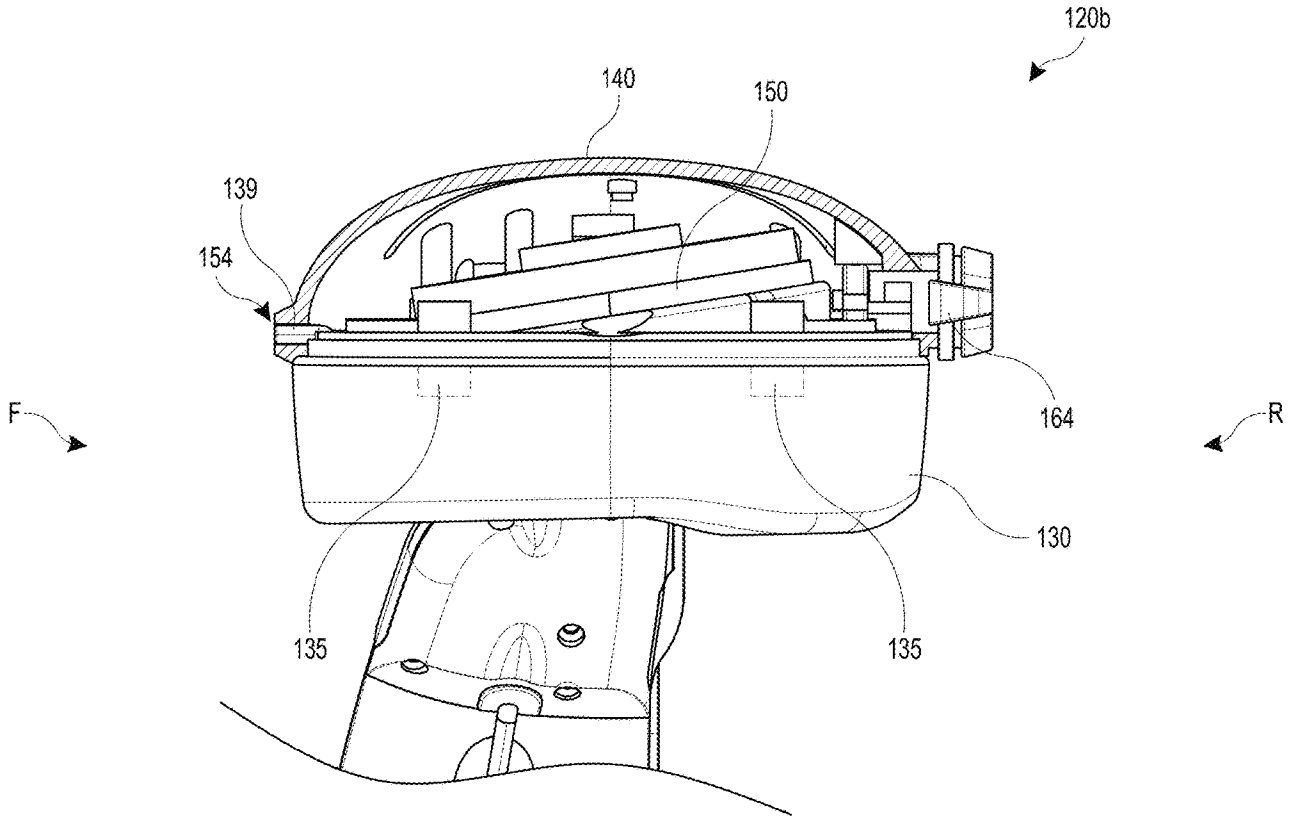
FIG. 8 is a partial end view of an ear cup assembly of the gaming headset of FIG. 4.
Figure 9:
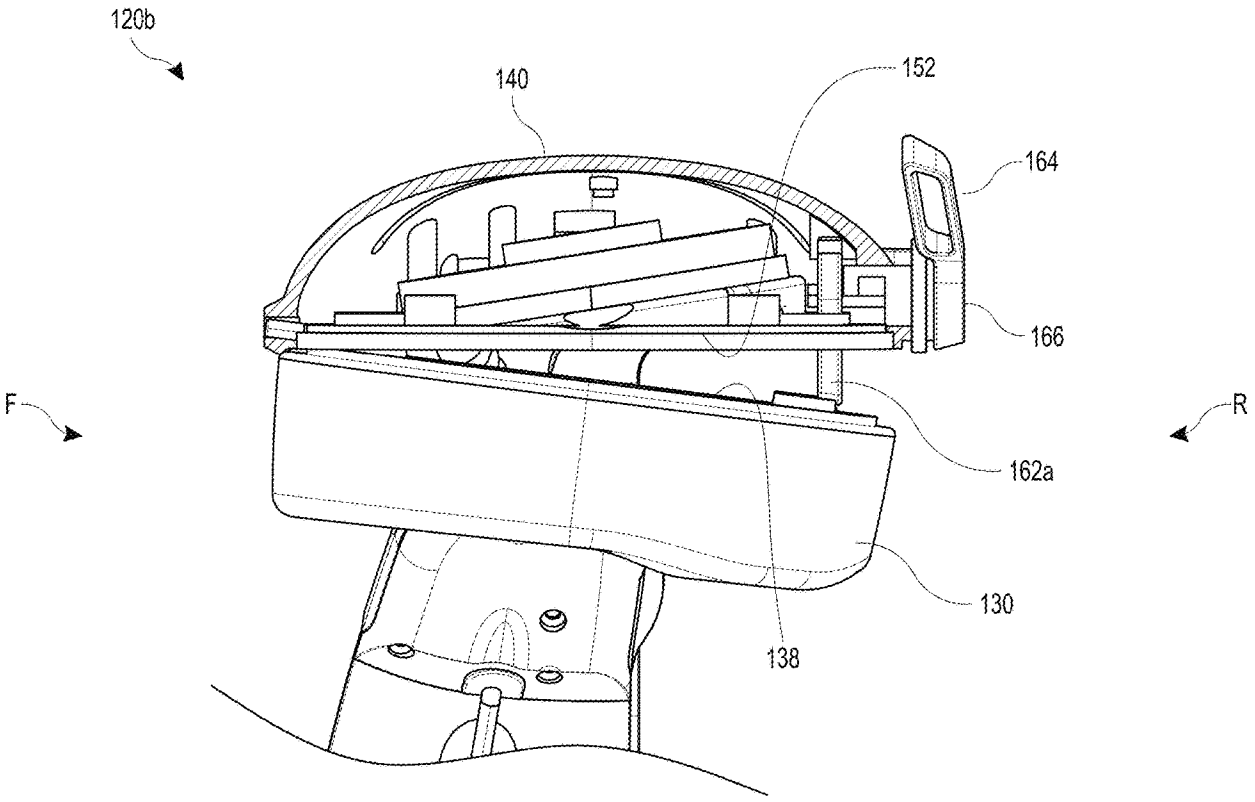
FIG. 9 is a partial end view of an ear cup assembly of the gaming headset of FIG. 5.
Figure 10:
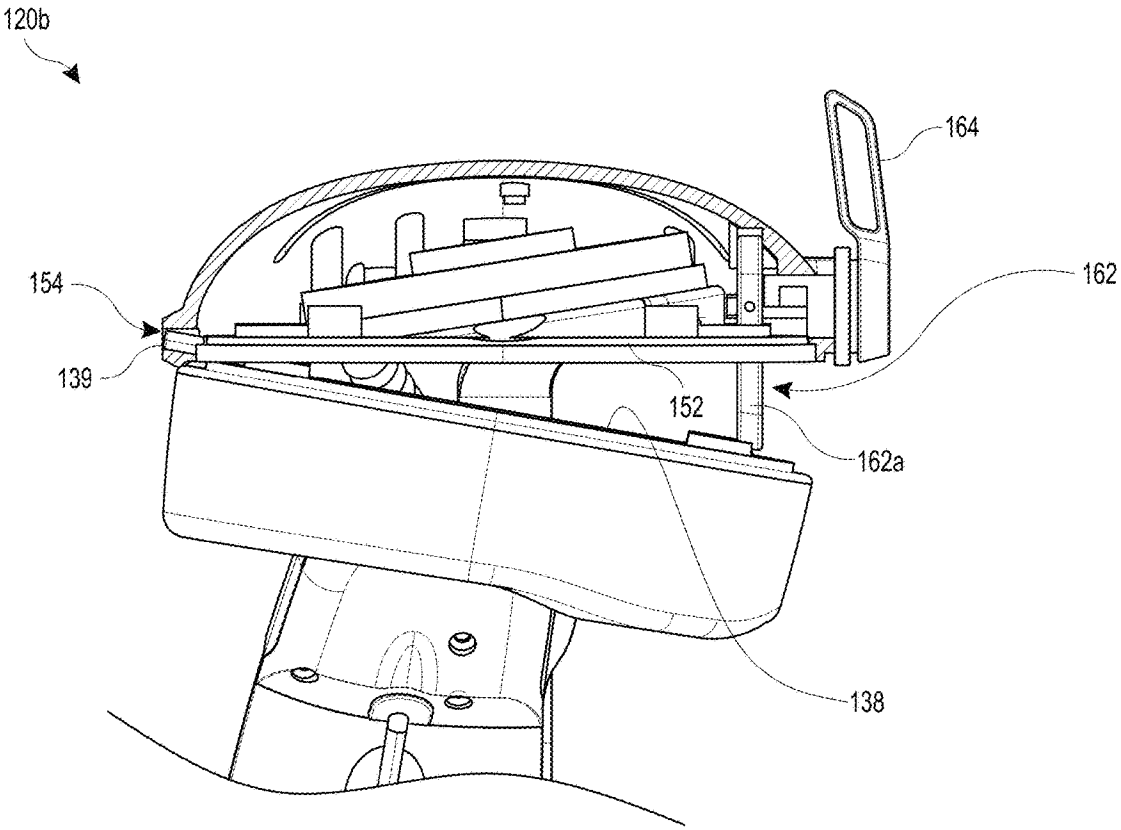
FIG. 10 is a partial end view of an ear cup assembly of the gaming headset of FIG. 6.
Figure 11:
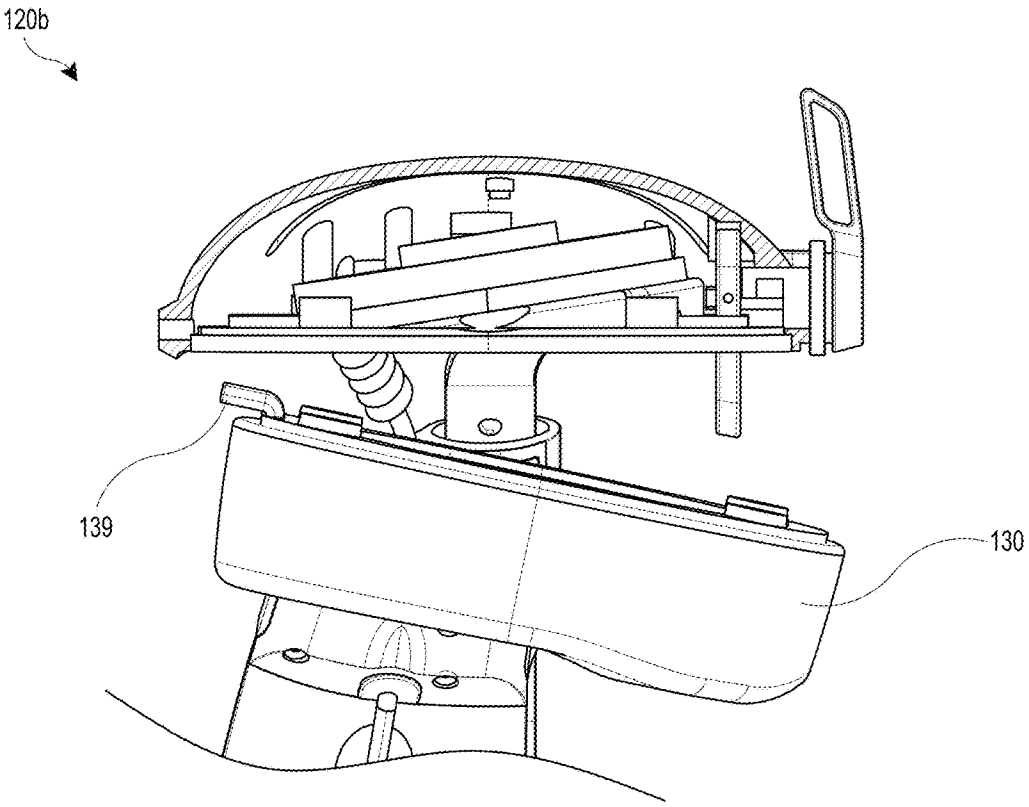
FIG. 11 is a partial end view of an ear cup assembly of the gaming headset of FIG. 7.

As shown in FIGS. 7 and 11, the ear pad 130 can be decoupled from the inner housing 150 and removed by operating the actuator 160 to separate the ear pad 130 from the inner housing 150 and withdrawing the tab 139 from the slot 154. Advantageously, such removal of the ear pad 130 allows for interchangeability of different types of ear pads 130, depending on the needs of the user. For example, interchangeable ear pads 130 can vary in material (e.g., polyurethane, memory foam), stiffness levels, thickness of the ear pad wall 136, etc.

Figure 12B:
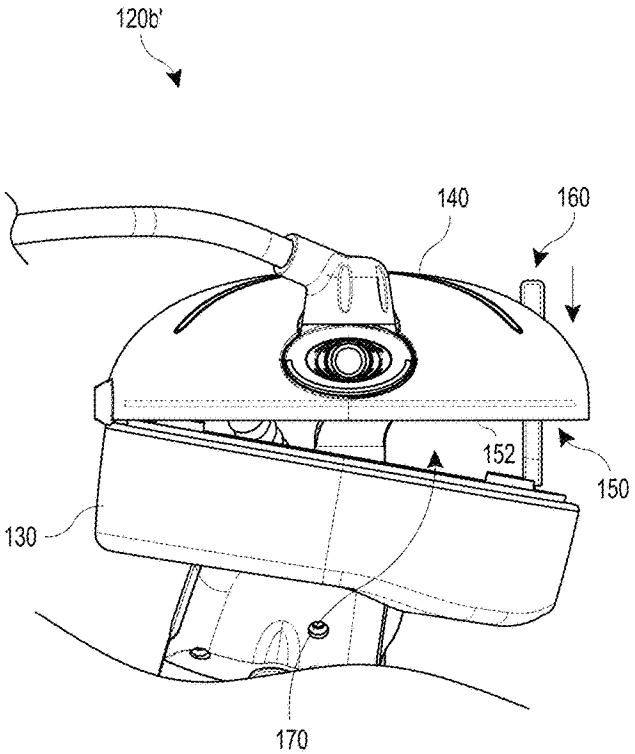
FIGS. 12A-12C are schematic side views of another embodiment of an ear cup assembly of a gaming headset.
Figure 12A:
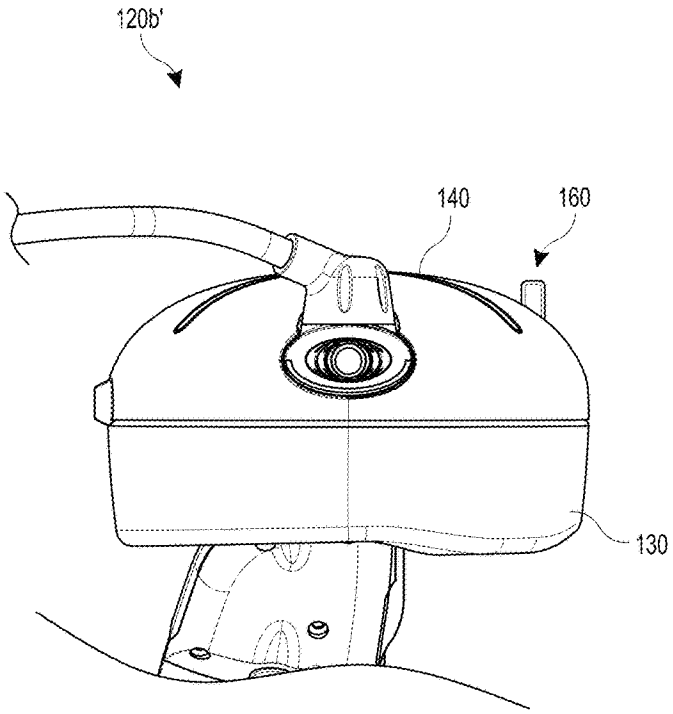
Figure 12C:
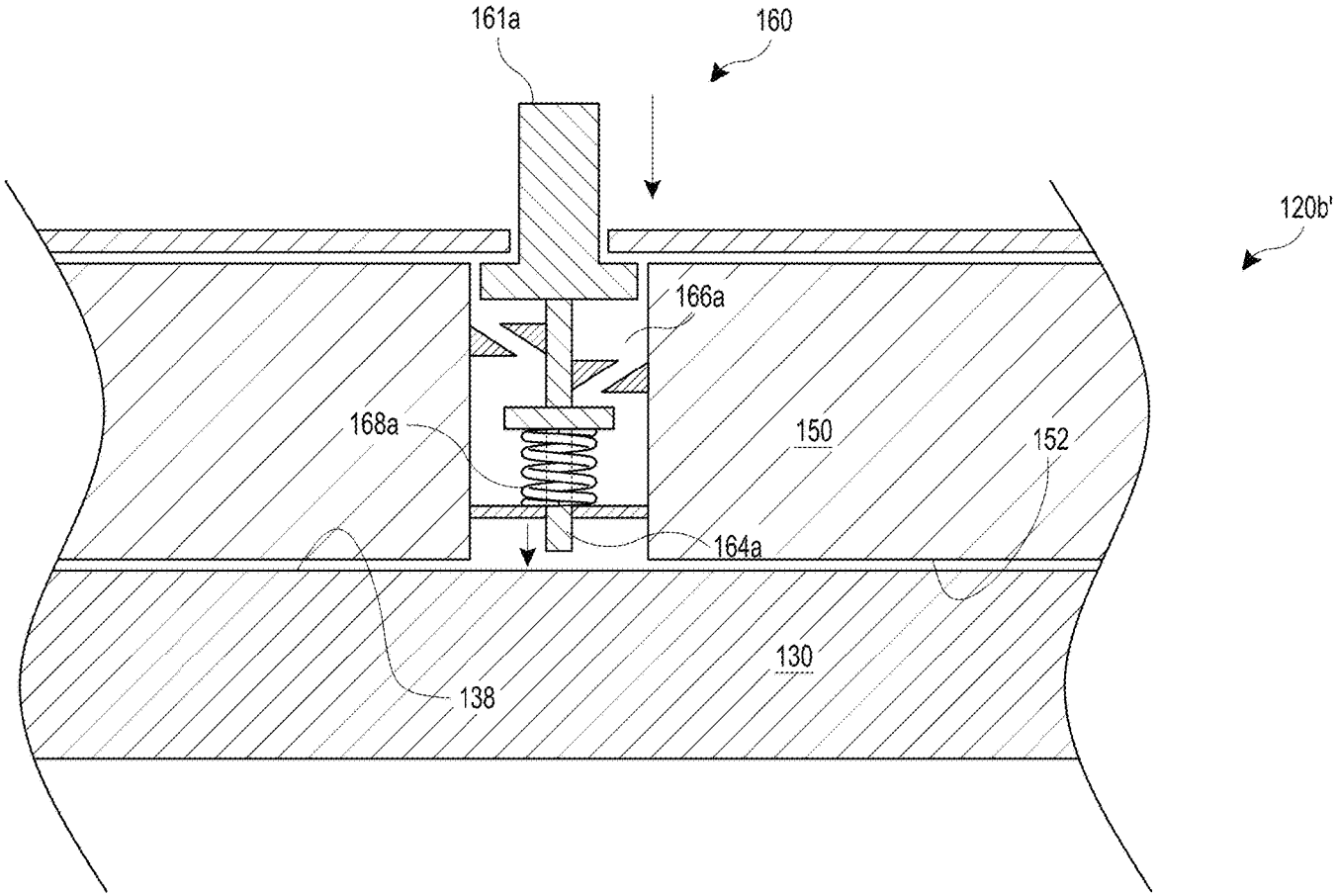

FIGS. 12A-12C show another embodiment of an ear cup assembly 120*b*'. In the illustrated embodiment, the actuator 160 is a push button mechanism with a push button 161A coupled to a distal push rod 164A in a spring loaded manner via a spring 168A. The actuator 160 can also have an indexing member 166A that allows the push button 161A to actuate the push rod 164A between a retracted position where the ear pad 130 is adjacent the inner housing 150 (see FIG. 12A) and a deployed position where a cam or contact surface 162*a* of the push rod 164A bears against the ear pad 130 to separate at least a portion of the ear pad 130 from the inner housing 150 (see FIG. 12B).

Figure 13C:
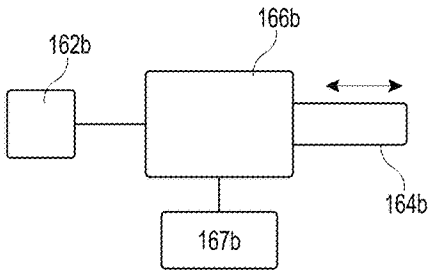
FIGS. 13A-13C are schematic side views of another embodiment of an ear cup assembly of a gaming headset.
Figure 13A:
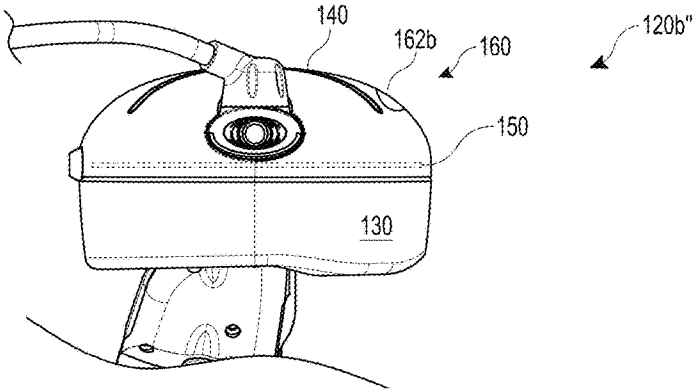
Figure 13B:
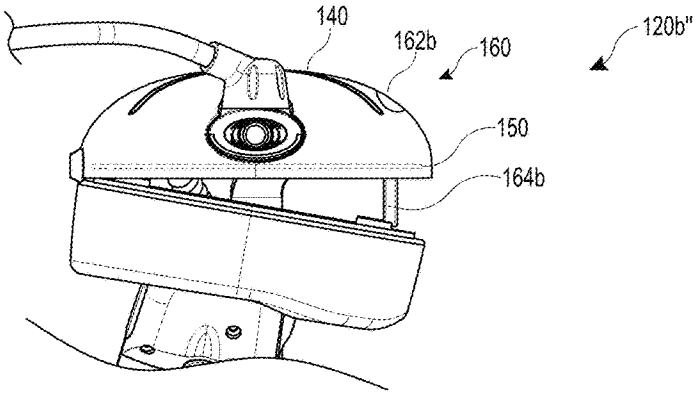

FIGS. 13A-13C show another embodiment of an ear cup assembly 120*b*". In the illustrated embodiment, the actuator 160 can include a user interface 162B (e.g., touch button) that can actuate an electric motor 166B (e.g., servo motor, linear actuator) that can be powered by a battery 167B to linearly move a push rod 164B between a retracted position where the ear pad 130 is adjacent the inner housing 150 (see FIG. 13A) and a deployed position where a cam or contact surface 162*a* of the push rod 164B bears against the ear pad 130 to separate at least a portion of the ear pad 130 from the inner housing 150 (see FIG. 13B).

Figure 14B:
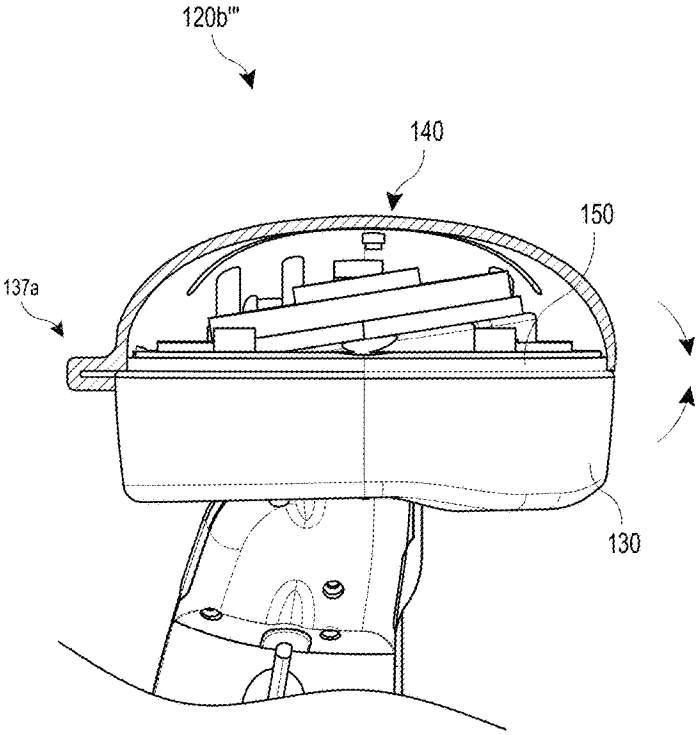
FIGS. 14A-14B are schematic side views of another embodiment of an ear cup assembly of a gaming headset.
Figure 14A:
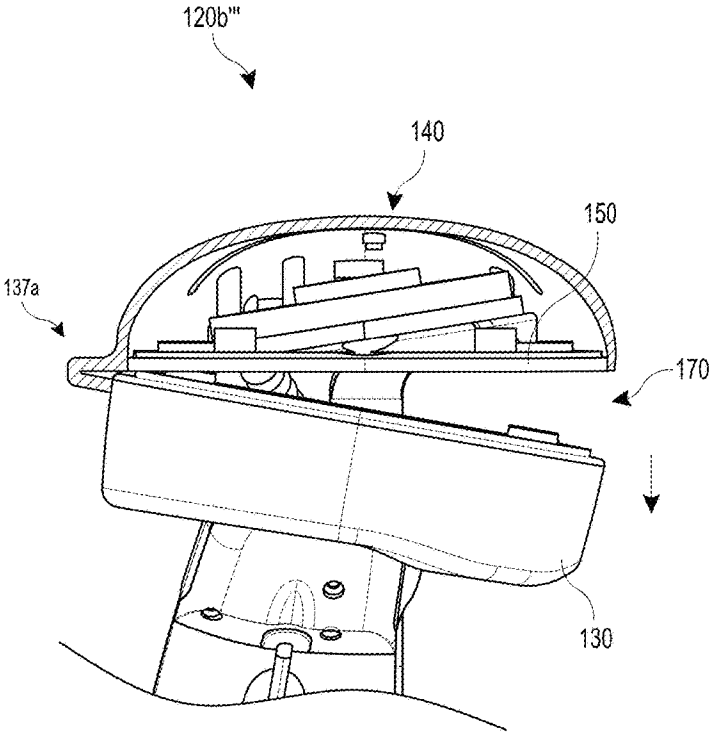

FIGS. 14A-14B show another embodiment of an ear cup assembly 120*b*'". In the illustrated embodiment, the hinge connection 137 between the ear pad 130 and the inner housing 150 can couple the two together in a manner that does not allow for the interchangeability of the ear pad 130. For example, in one embodiment a hinge 137A can be provided by an elastically deformable material or a shape memory material (e.g., shape memory plastic). In the illustrated embodiment, the hinge 137A can be operated between a first position (see FIG. 14A) where the hinge 137A is flexed and the ear pad 130 is separated from the inner housing 150 (via actuation of the actuator 160) to define the gap 170 therebetween, and a second position (see FIG. 14B) where the hinge 137A is unflexed and the ear pad 130 is adjacent the inner housing 150 (e.g., when the actuator 160 is moved to the retracted position).

As discussed above, in one embodiment, the ear pad assembly 120*b* can include one or more magnets 156 in the inner housing 150 and one or more magnets 135 in the ear pad 130 that maintain the ear pad 130 in contact with the inner housing 150 when the actuator 160 is not actuated to separate the two from each other. In another embodiment, the magnets 156, 135 can be excluded. Rather, the shape memory material of the hinge 137A (see FIG. 14A-14B) can provide a snap fit hinge that biases the ear pad 130 into contact with the inner housing 150 when the actuator 160 is in the retracted position. In another embodiment, the hook or tab 139 can click into the slot 154 (e.g., can have a protrusion that clicks over the slot 154 when the ear pad 130 is adjacent the inner housing 150) to retain the ear pad 130 in contact with the inner housing 150. A user can then pull on the ear pad 130 to withdraw the protrusion from the slot 154, allowing the ear pad 130 to tilt away from the inner housing 150 (e.g., via actuation of the actuator 160).

In the illustrated embodiment, the user can manually rotate the cam 162 between the retracted and deployed positions by the user manually pivoting or rotating the handle 164 about the pivot axis 166 while wearing the headset 100. Advantageously, when the cam 162 is in the deployed position, the gap 170 allows air to flow in and out of the cavity 134 to reduce in-cup air temperature and in-cup relative humidity, thereby increasing the level of comfort for the user, especially during prolonged use of the headset 100 (e.g., during a gaming session or competition).

While the embodiments above describe different features in a gaming headset, one of skill in the art will recognize that these features are not limited to a gaming headset and can be incorporated into other types of headsets (e.g., audio headsets), and which the invention also contemplates.

While certain embodiments of the invention have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel", or "generally perpendicular" and "substantially perpendicular", refer to a value, amount, or characteristic that departs from exactly parallel, or from exactly perpendicular, by less than or equal to 15 degrees, less than or equal to 10 degrees, less than or equal to 5 degrees, less than or equal to 3 degrees, less than or equal to 1 degree, or less than or equal to 0.1 degree.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future.

What is claimed is:

1. A gaming headset, comprising:

a headband configured to fit over a user's head; and a pair of ear cup assemblies coupled to the headband via a pair of arms, where each of the ear cup assemblies comprises an ear pad, an outer housing, an inner housing interposed between the outer housing and the ear pad, a hinge assembly on a front facing side of the ear cup assembly that movably couples the inner housing and the ear pad, the hinge assembly comprising a hook releasably coupled to a slot in the inner housing, and an actuator disposed on a rear facing side of the ear cup assembly from the hinge assembly, the actuator being selectively acuatable to move a cam surface between a retracted position in the inner housing and a deployed position protruding from the inner housing, where in the retracted position the ear pad is in contact with the inner housing, and where in the deployed position the cam surface is moved into contact with a surface of the ear pad to tilt at least a portion of the ear pad relative to the inner housing to define a gap therebetween that opens toward the rear of the ear cup assembly and vents an in-ear space bounded by the ear pad and the inner housing.

2. The gaming headset of claim 1, further comprising one or more magnets in the inner housing and in the ear pad with opposing polarities that apply an attraction force between the ear pad and the inner housing, the one or more magnets configured to bias the ear pad into contact with the inner housing.

3. The gaming headset of claim 1, wherein the ear pad is configured to be decoupled from the inner housing and interchanged.

4. The gaming headset of claim 1, wherein the actuator is a mechanical actuator comprising a lever rotatable by the user about an axis of rotation, the lever operatively coupled to a cam that rotates along with the lever to move the cam surface into and out of contact with a surface of the ear pad.

5. The gaming headset of claim 1, wherein the actuator is a mechanical actuator comprising a spring loaded push button actuatable by the user to move a cam surface into and out of contact with a surface of the ear pad.

6. The gaming headset of claim 1, wherein the actuator is an electrical actuator comprising a user interface and an electric motor that moves a cam surface into and out of contact with a surface of the ear pad.

7. The gaming headset of claim 1, wherein the cam surface that contacts the ear pad is curved and configured to provide continuous and gradual contact with the ear pad and inhibit noise during movement of the cam surface between the retracted and deployed positions.

8. The gaming headset of claim 7, wherein the inner housing comprises a ledge that the cam contacts when in the deployed position, the ledge configured to prevent rotation of the cam past the ledge.

9. A gaming headset, comprising:

a headband configured to fit over a user's head; and a pair of ear cup assemblies coupled to the headband via a pair of arms, where each of the ear cup assemblies comprises an ear pad, a housing, a hinge assembly on one side of the ear cup assembly that movably couples the housing and the ear pad, and an actuator disposed on an opposite side of the ear cup assembly from the hinge assembly, the actuator being selectively acuatable to move a cam surface between a retracted position in the housing and a deployed position protruding from the housing, where in the retracted position the ear pad is in contact with the housing, and where in the deployed position the cam surface is moved into contact with a surface of the ear pad to separate at least a portion of the ear pad from the housing to define a gap therebetween that vents an in-ear space in the ear cup assembly bounded by the ear pad and the housing.

10. The gaming headset of claim 9, further comprising one or more magnets in the housing and in the ear pad with opposing polarities that apply an attraction force between the ear pad and the housing, the one or more magnets configured to bias the ear pad into contact with the housing.

11. The gaming headset of claim 9, wherein in the deployed position the cam surface tilts the ear pad relative to the housing to define the gap therebetween.

12. The gaming headset of claim 9, wherein the hinge assembly includes a hook attached to the ear pad that releasably hooks onto a slot in the housing.

13. The gaming headset of claim 9, wherein the ear pad is configured to be decoupled from the housing and interchanged.

14. The gaming headset of claim 9, wherein the actuator is a mechanical actuator comprising a lever rotatable by the user about an axis of rotation, the lever operatively coupled to a cam that rotates along with the lever to move the cam surface into and out of contact with a surface of the ear pad.

15. The gaming headset of claim 9, wherein the actuator is a mechanical actuator comprising a spring loaded push button actuatable by the user to move a cam surface into and out of contact with a surface of the ear pad.

16. The gaming headset of claim 9, wherein the actuator is an electrical actuator comprising a user interface and an electric motor that moves a cam surface into and out of contact with a surface of the ear pad.

17. The gaming headset of claim 9, wherein the cam surface that contacts the ear pad is curved and configured to provide continuous and gradual contact with the ear pad and inhibit noise during movement of the cam surface between the retracted and deployed positions.

18. The gaming headset of claim 17, wherein the housing comprises a ledge that the cam contacts when in the deployed position, the ledge configured to prevent rotation of the cam past the ledge.

19. The gaming headset of claim 9, wherein the hinge assembly comprises a hinge body of a shape memory material configured to bias the ear pad into contact with the housing and to flex when the actuator moves the cam surface into the deployed position.

20. The gaming headset of claim 9, wherein the hinge assembly is located on a front side of ear cup assembly and the actuator is located on a rear side of the ear cup assembly such that the gap opens toward the rear of the ear cup assembly when the cam surface is in the deployed position.

* * * * *